US005911275A

United States Patent [19]

McGarian et al.

[11] Patent Number: 5,911,275

[45] Date of Patent: Jun. 15, 1999

[54] APPARATUS FOR MILLING A WELL CASING

[76] Inventors: Bruce McGarian, 23 East Glebe, Stonehaven, Aberdeen AB3 2HW, United Kingdom; Werner B. Lau, Grange Lodge, South Avenue, Cults, Aberdeen AB1 9LT, United Kingdom; Rory McCrae Tulloch, 20 Ashley Park North, Aberdeen AB1 6SF, United Kingdom

[21] Appl. No.: 08/809,834

[22] PCT Filed: Sep. 25, 1995

[86] PCT No.: PCT/GB95/02267

§ 371 Date: May 6, 1997

§ 102(e) Date: May 6, 1997

[87] PCT Pub. No.: WO96/09460

PCT Pub. Date: Mar. 28, 1996

[30] Foreign Application Priority Data

Sep. 23, 1994 [GB] United Kingdom ..... 9419222
Nov. 11, 1994 [GB] United Kingdom ..... 9422837

[51] Int. Cl.[6] ..... E21B 7/06

[52] U.S. Cl. ..... 166/117.6

[58] Field of Search ..... 166/50, 55.7, 117.5, 166/117.6, 123, 381, 382

[56] References Cited

U.S. PATENT DOCUMENTS

| | | | |
|---|---|---|---|
| 2,105,721 | 1/1938 | Cutrer et al. . | |
| 2,105,722 | 1/1938 | Barrett et al. | 166/117.6 X |
| 2,196,528 | 4/1940 | Hughes | 166/117.6 X |
| 2,669,429 | 2/1954 | Zublin . | |
| 2,669,430 | 2/1954 | Zublin . | |
| 2,807,440 | 9/1957 | Beck . | |
| 3,602,306 | 8/1971 | Alexander . | |
| 5,186,254 | 2/1993 | van Staden . | |
| 5,277,251 | 1/1994 | Blount et al. . | |
| 5,335,737 | 8/1994 | Baugh | 166/117.6 X |
| 5,341,873 | 8/1994 | Carter et al. | 166/117.6 X |
| 5,346,017 | 9/1994 | Blount et al. . | |

OTHER PUBLICATIONS

International Publication No. WO 95/07404 to T. Carter et al., dated Mar. 16, 1995, entitled "Apparatus for Use in a Wellbore".

*Primary Examiner*—Roger Schoeppel
*Attorney, Agent, or Firm*—Watson Cole Grindle Watson, P.L.L.C.

[57] ABSTRACT

Apparatus for milling a well casing (15) includes an elongate guide member (1) having a leading end and a trailing end, the guide member having defined thereon a guide track (23) which, in the use position of the guide member, converges with the well casing to be milled from the trailing end of the guide member towards the leading end thereof. A support member (4) is selectively movable along the guide track from the trailing end towards the leading end of the guide member to converge with the well casing to be milled. A milling tool (5) has a leading end rotatably supported by the support member (4) and includes milling means (6) located rearwardly of its leading end. A releasable coupling initially maintaining the support member (4) and leading end of the milling tool adjacent the trailing end of the guide member is releasable to permit movement of the support member (4) along the guide track towards the leading end of the guide member to bring the milling means into milling engagement with the casing to be milled.

11 Claims, 6 Drawing Sheets

APPARATUS FOR MILLING A WELL CASING

BACKGROUND OF THE INVENTION

This invention relates to apparatus for milling a well casing, and more particularly to apparatus for milling a window at a desired position in one side of a well casing.

In the exploitation of oil and gas wells it is sometimes necessary to form an opening in the steel well casing. For certain applications the orientation of the opening relative to ground co-ordinates is important. It has been proposed to form such an opening by use of one or more milling tools and the present invention, in its preferred embodiment, provides apparatus for forming such an opening (hereinafter referred to as "a window") by means of a milling tool.

SUMMARY OF THE INVENTION

According to one aspect of the present invention there is provided apparatus for milling a well casing including an elongate guide member having a leading end and a trailing end, the guide member having defined thereon a guide track which, in the use position of the guide member, converges with the well casing to be milled from the trailing end of the guide member towards the leading end thereof; a support member which is selectively movable along the guide track in the direction from the trailing end towards the leading end of the guide member to converge with the well casing to be milled; a milling tool having a leading end rotatably supported by the support member and milling means located rearwardly of its leading end; and a releasable coupling initially maintaining the support member and leading end of the milling tool adjacent the trailing end of the guide member and releasable to permit movement of the support member along the guide track towards the leading end of the guide member to bring the milling means into milling engagement with the casing to be milled.

The milling means may be any suitable configuration for milling the material of the well casing. The milling tool may be driven by a motor located adjacent the tool or may be driven by rotation of the drill pipe to which it is connected. In the preferred embodiment of the invention the tool is adapted to be run into a well bore on coil tubing and incorporates a motor located immediately rearwardly of the milling tool for rotating the milling means, a coil tubing connector, a by-pass valve assembly and a blow-out sub. If the tool is embodied to be used with drill pipe which is capable of imparting rotation to the milling means the coil tubing connector, by-pass valve assembly and blow-out sub may be omitted.

The preferred embodiment of the invention offers a number of improvements as compared with prior art systems for window milling. In particular, the use of a support member moveable along the guide track and in which the leading end of the milling tool is rotatable supported offers particularly good support and guidance for the milling tool and reduces the operating torque required to effect milling of the casing. Also, by suitably designing the guide member the overall diameter of the apparatus as it is run into the well can be significantly less than the diameter of the casing to be milled. For example, the preferred embodiment of the invention, in the configuration in which it is run into the well, will pass through a restriction of 3.813 inches (96.85 mm) and yet will be able to mill a window in casing having an inside diameter of 6 inches (152.4 mm) or thereabouts.

In the case of embodiments intended to mill a casing having an inside diameter substantially larger than the initial overall diameter of the apparatus, means are provided for orientating the guide member within the casing such that the trailing end of the guide member rests against the casing adjacent one side thereof and the leading end of the guide member is held adjacent the casing on the diametrically opposite side thereof to the point of engagement of the trailing end with the casing. With the guide member maintained in this orientation the guide track will extend from adjacent one side of the casing obliquely across the casing towards the diametrically opposite side of the casing. The angle at which the guide track converges with the casing wall will be the sum of the angle which the longitudinal axis the guide member makes with the casing longitudinal axis and the angle which the guide track makes with the longitudinal axis of the guide member. In one embodiment of the invention adapted to operating in a casing of 6 inches (152.4 mm) inside diameter the guide member may have a guide track which extends at 1.75 degrees to the longitudinal axis of the guide member and the guide member itself may, in use, be located to extend with its longitudinal axis at an angle of 1.5 degrees relative to the longitudinal axis of the casing thereby giving a total angle of convergence of the guide track with the casing of 3.25 degrees.

In a particularly preferred embodiment of the invention, the leading end of the guide member is connected to the next adjacent component of the system by a hinged link which is operative, during installation of the apparatus and prior to milling, to move the leading end of the guide member to a position adjacent one wall of the casing and to maintain the leading end of the guide member in that position during subsequent use. Conveniently, the hinged link may itself engage the opposite wall of the casing to act as a strut to maintain the leading end of the guide member in the desired position.

In a particularly preferred embodiment of the invention the guide member may be in the form of a whipstock on which the required guide track is milled.

In a particularly preferred embodiment of the invention means are provided for retaining the support member in the correct position relative to the guide track as the support member advances along the guide track, the retainer means being releasable to permit subsequent withdrawal of the milling tool and support member from the well.

If the orientation of the window relative to ground co-ordinates is important, the apparatus of the invention is provided with means for orientating the guide member to provide the milled window at the correct position. Such means may conveniently be provided by a locating member which will mate with a previously set anchor in only one relative rotational position. The locating member is coupled to the leading end of the guide member by means which prevent relative rotation between the guide member and the locating member about the longitudinal axis of the tool. Accordingly, the anchor is first set at the correct orientation relative to the casing and the apparatus of the present invention is then run into the well until the locating member engages with the anchor. Correct engagement of the locating member with the anchor (which can be verified by conventional techniques) will then assure that the guide member is at the correct orientation relative to the casing to provide the milled window at the correct position.

It should be understood, however, that other arrangements are possible, and in particular an appropriate anchor or anchor packer may form part of the apparatus of the present invention in which case suitable means would be provided for orientating the assembly relative to the desired co-ordinates prior to setting of the anchor.

In a particularly preferred embodiment of the invention the leading end of the milling apparatus is supported in the support member via a sealed bearing system having a pressure compensated lubrication arrangement. To this end, the leading end of the milling tool preferably includes a piston which defines one wall of a lubricant reservoir supplying lubricant to the sealed bearing system and which, on the other side, is exposed to well fluid pressure. This arrangement assures particularly low friction resisting rotation of the milling tool and reduces to a minimum torque transferred via the support member to the guide member.

The above and further features and advantages of the invention will becomes clear from the following description of a preferred embodiment thereof, given by way of example only, reference being had to the accompanying drawings.

DETAILED DESCRIPTION OF THE PREFERRED EMBODIMENT

Figure 1:
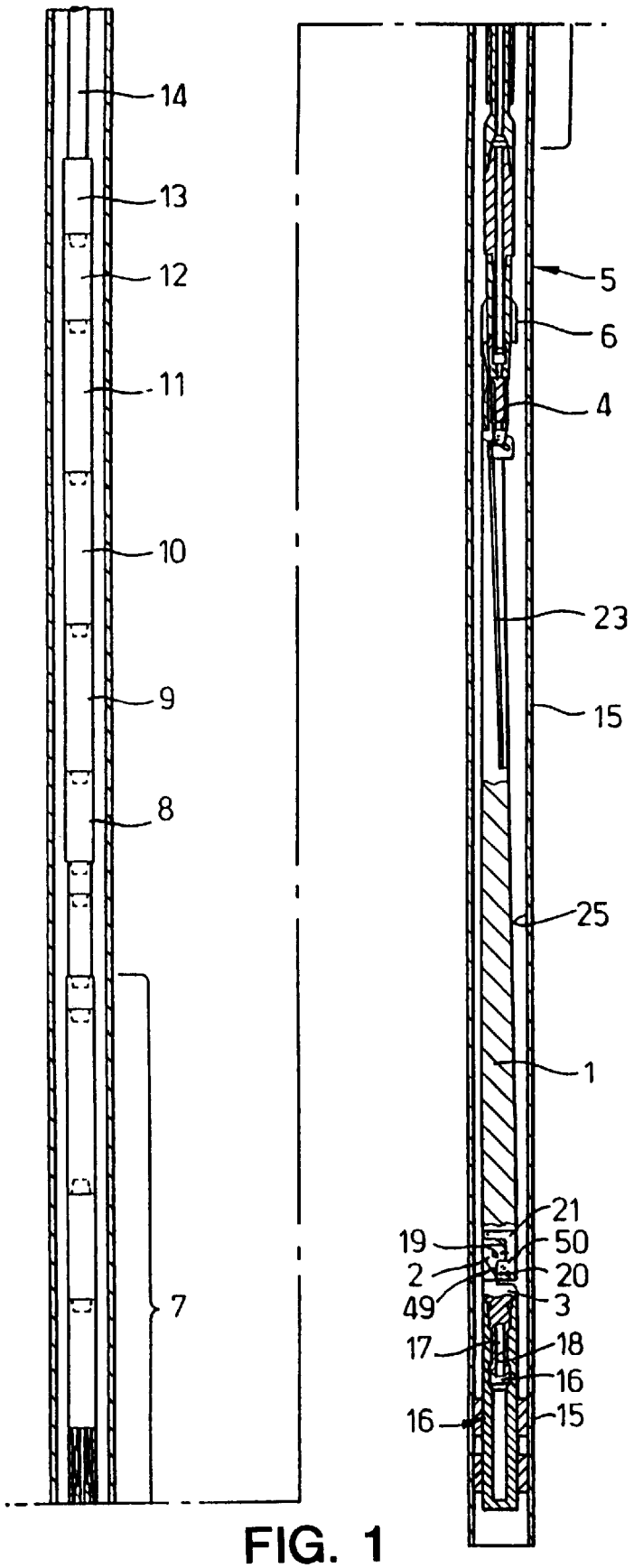
FIG. 1 illustrates schematically an embodiment of the invention locating within a well casing.

Referring firstly to FIG. 1, the illustrated embodiment of the present invention includes an elongate guide member 1 connected at the lower end thereof by a link 2 to a locating member 3. The upper end of the guide member 1 has connected thereto a support member 4 which rotatably supports the leading end of a motor driven milling tool 5, which itself includes milling means 6 which, in use, is rotated by a motor 7. The milling means 6 may be of any suitable configuration and, in the preferred embodiment, is constituted by a plurality of blades as described in more detail below. The motor 7 is connected to a blow-out sub 8 and then to a by-pass valve 9 and then by suitable nonmagnetic collars to a steering tool 10 which itself is connected by a non-magnetic collar to an orienting tool 11. The orienting tool 11 is connected to a hydraulic disconnect 12 which is in turn connected to a flapper valve 12A and then a coil tubing connector 13 located at the end of a coil tubing 14. The entire structure is located within a well casing 15 and, in the illustrated configuration, has been connected to a anchor/packer 16 set in the casing.

It will be noted that the overall diameter of the illustrated apparatus from the locating member 3 to the coil tubing connector 13 is substantially less than the inside diameter of the casing 15. Accordingly, the entire assembly can be run into the well through one or more restrictions having an inside diameter significantly less than the inside diameter of the casing to be milled.

Figure 2:
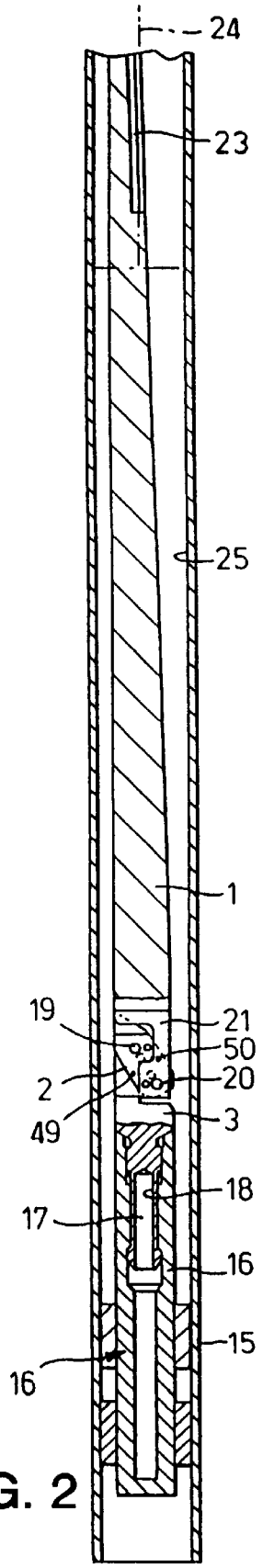
FIG. 2 illustrates, on a larger scale, the lowest portion of an embodiment of the invention.

Referring now to FIG. 2 a lowermost portion of the apparatus according to the invention, and the anchor/packer 16, are illustrated in greater detail. The anchor/packer 16 does not itself form part of the embodiment of the invention and is illustrated only schematically in the drawings. The anchor/packer 16 may be of any suitable type. The anchor/packer is set in the casing by suitable means and at a predetermined depth below the position of the desired milling zone prior to running in of the apparatus according to the present invention. The leading end of the apparatus according to the present invention is formed by a stinger 17 which mates with the bore 18 of the anchor/packer 16. If the orientation of the zone to be milled, relative to ground co-ordinates, is critical the stinger 17 and mating bore 18 will be provided with interengaging components which assure that the stinger can mate with the bore 18 in only one relative angular position thereof. By way of example, the stinger may be provided with a key which mates with a keyway provided in the bore 18. By this means, provided that the anchor/packer is set at the correct orientation within the casing prior to running in of the apparatus of the present invention, the locating member 3 will be correctly angularly located after engagement with the bore 18.

The locating member 3 is connected to the guide member 1 by means of a link 2 and a pair of hinge pins 19, 20. The joint provided by the link 2 and hinge pins 19, 20 permits limited longitudinal and transverse displacement of the guide member 1 relative to the locating member 3 as described hereinafter, but prevents relative axial rotation between the guide member 1 and locating member 3 so that if the locating member 3 is correctly orientated by virtue of its engagement with the anchor/packer 16 the guide member 1 will be correctly orientated to provide milling at the desired position on the casing.

The guide member 1 is in the form of a whipstock having a leading end 21 and a trailing end 22. A guide track 23 is provided on the whipstock and extends obliquely relative to the longitudinal axis 24 of the whipstock so that the guide track 23 converges with the wall 25 of the casing in a direction from the trailing end 22 towards the leading end 21.

Figure 6:
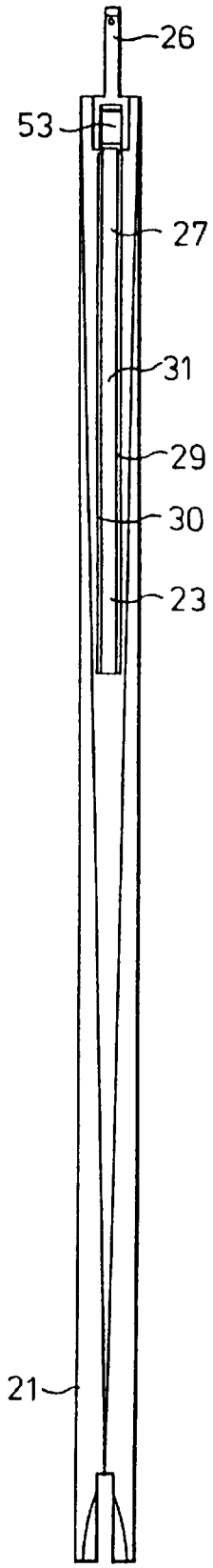
FIGS. 5 and 6 show respectively a longitudinal cross-section and a plan view of the guide member of the embodiment of FIGS. 1–4.
Figure 5:
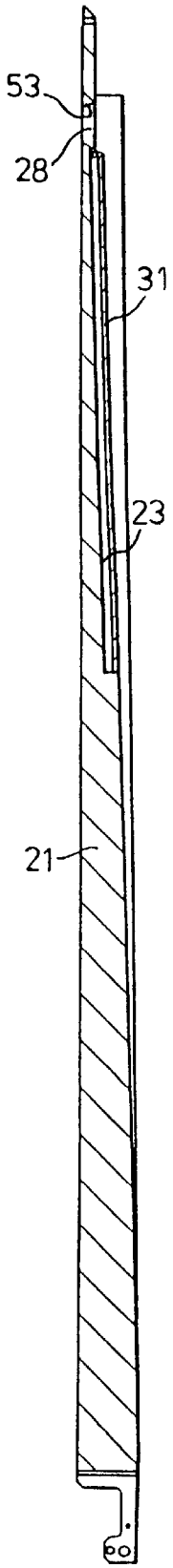

The structure of the guide member is shown in more detail in FIG. 5 and 6. As can be seen from those Figures the whipstock is of generally tapering construction which varies in cross-section from a full section solid substantially cylindrical configuration at the leading end 21 to a relatively thin and narrow tang 26 at the trailing end. In transverse cross-section the whipstock is, over the central portion of its length, generally of crescent shape to provide maximum resistance against transverse deflection whilst at the same time providing clearance for the milling means of the milling tool, as described in more detail below. It should be noted that the guide track 23 terminates, adjacent the trailing end of the whipstock, in a ramp 27 leading to a through slot 28 in the body of the whipstock. Preferably, the track 23 is furnished with a pair of retaining members 29, 30 which extend towards each other to define therebetween a slot 31 which is narrower than the track 23 itself.

Figure 3:
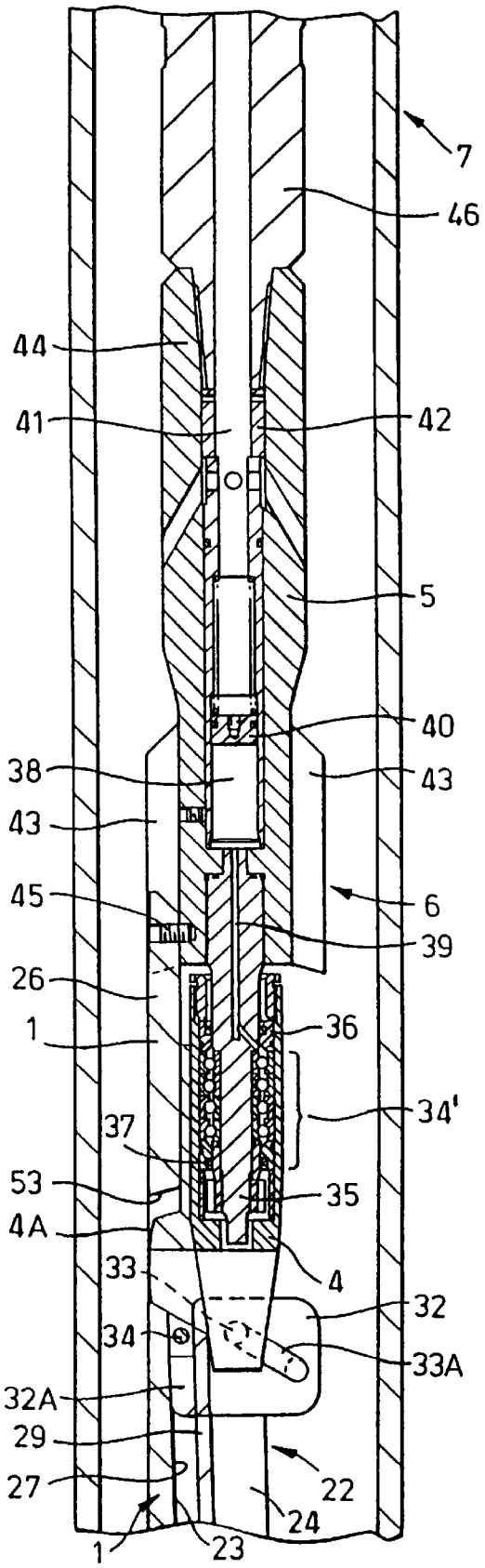
FIG. 3 illustrates on a larger scale, in cross-section, the portion of the embodiment of the invention located immediately above that illustrated in FIG. 2.

Referring now to FIG. 3 the support member 4 is shown in its initial position relative to the whipstock guide member 1. In this configuration a travelling block 32 of the support member 4 extends through the slot 31 between the retaining members 29, 30. The travelling block 32 is of generally inverted T-shape in transverse cross-section and includes a head portion 32A which is trapped beneath the retaining members 29, 30. Thus, as the travelling block 32 slides along the track as described hereinafter it is constrained against moving away from the track by the engagement of the head portion 32A with the undersides of the retaining members 29,30. The travelling block 32 is connected to the body of the support member 4 by a pin 33 which runs in a slot 33A in the travelling block and is positioned on the axis of the mill bearing assembly to ensure the mill blade gauge diameter will be parallel to the whipstock surface. This ensures that the mill will not mill the whipstock even though clearance between the blades of the mill and the whipstock itself is relatively small. A heel block 4A of the body of the support member 4 supports the radial weight of the milling string on the whipstock surface.

The support member 4 carries ball-bearings 34 which rotatably support a spigot 35 which forms the leading end of the milling tool 5. The bearings 34 are sealed against well fluid by appropriate seals 36, 37 and are lubricated by oil or grease from a reservoir 38 via a passage 39. One end of the reservoir 38 is formed by a piston 40 which is exposed, on the side thereof opposite the reservoir 38, to the pressure of drilling fluid as it flows from the central passage 41 of a sleeve 42 outwardly through radial passages provided adjacent the upper end of the sleeve 42. By this means—pressure within the reservoir 38 will always remain substantially equal to or higher than fluid pressure subsisting on the exterior of the seals 36, 37 and ingress of well fluid to the bearings 34' will be prevented. The addition of a spring to push the piston results in the pressure in the reservoir being slightly higher than the ambient mud pressure. This helps prevent mud ingress and also encourages oil to be located between the rotational seal and the journal surfaces to reduce seal and shaft wear and increase system life whilst reducing torque applied to the whipstock. The reservoir pressure is typically 10–100 psi above ambient. The oil is put into the chamber through a side port using a T-piece with one side connected to a vacuum pump and the other side to an oil reservoir and supply pump.

Figure 4:
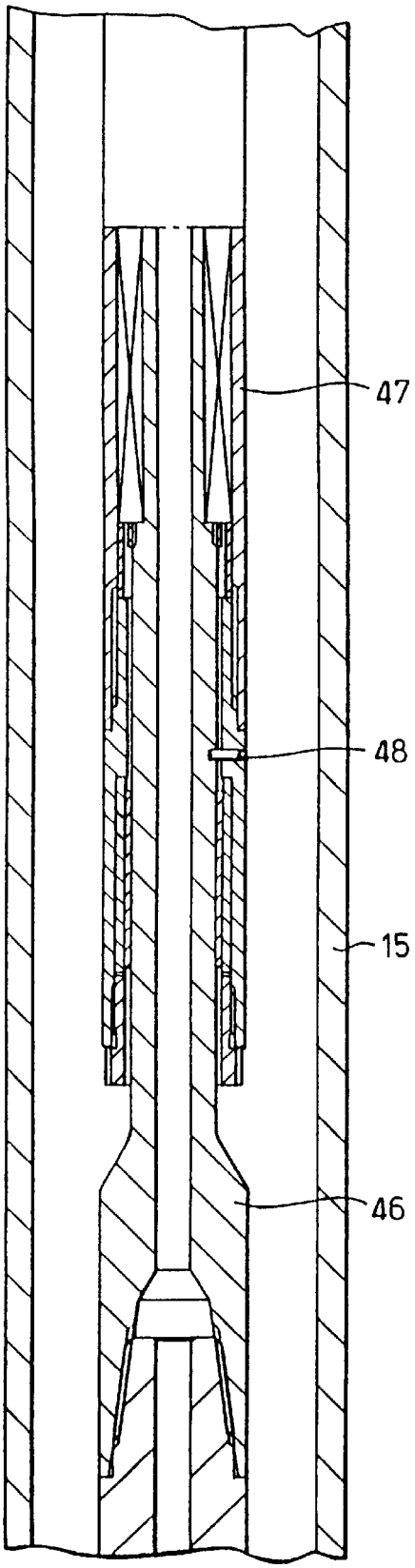
FIG. 4 illustrates the portion of the embodiment of the invention located immediately above the portion illustrated in FIG. 3.

The milling tool 5 comprises a milling means 6 provided, in the illustrated embodiment, by four tungsten carbide dressed blades 43 (only two of which are visible in FIG. 4). The blades will preferably be of spiral configuration. The blades are positioned such that, in the illustrated starting configuration of the components, the tang 26 forming the upper extremity of the whipstock can be accommodated between adjacent blades. With the components in this configuration, the tang 26 is secured to the body 44 of the milling tool 5 by means of a shear pin 45 or other releasable element.

The milling tool 5 also includes a motor 7 having an output shaft 46 which is connected to the body 44 and a bearing casing 47 (FIG. 4). The structure of the motor may be conventional save that a shear pin 48 or other suitable means is provided to initially lock the stator and rotor relative to each other to prevent relative rotation therebetween. This is necessary to ensure that the entire assembly below the orienting tool 11 can be rotated as a unit to bring it into the correct angular orientation relative to the anchor/packer 16 to permit entry of the stinger 17 into the bore 18, as described above.

In order to mill a casing window using the apparatus described above, the packer anchor is first set at the correct orientation by any suitable conventional technique. If necessary, as a preliminary to setting the anchor the casing will be cleaned by means of an under-reamer or similar tool to ensure that the anchor, when set, will adequately resist the load applied to it. The assembly described above is then run into the well and, when the stinger 17 engages the upper end of the anchor 16 the orienting tool 11 is operated in light of information provided by the steering tool 10 to rotate the assembly until the stinger 17 can engage the anchor bore 18. When the stinger has engaged the anchor bore, the assembly is picked up to confirm that the stinger has latched to the anchor. For this purpose, an overpull of, for example, 1000 lbs may be applied to the string. This not only confirms that the stinger is secured to the anchor but also confirms that the anchor is firmly set within the casing. The tension in the string is then increased (to, for example, 2000 lbs) and accordingly a tensile force is applied to the joint between the whipstock and the locating member 3. This load causes shearing of the shear pins 49, 50 which initially maintain the components in the configuration illustrated in FIG. 2. The shearing of the pins permit the components to move into the configuration illustrated in FIG. 7 in which the link 2 engages one side of the casing to hold the leading end of the whipstock guide member 1 adjacent the opposite side of the casing.

It will be appreciated that, whilst in the preferred embodiment uploading (tension) is used to shear the pins 49, 50 holding the locating member 3, link 2 and guide member 1 in their initial configuration, as an alternative the link could be rearranged to provide for shearing of shear pins under compression followed by rotation of the link by lowering the string. In the alternative, the hinge mechanism could be completely reversed and the running position altered such that after shearing of shear pins by compression the hinge will move automatically under the applied compression into the desired operative configuration.

Figure 7:
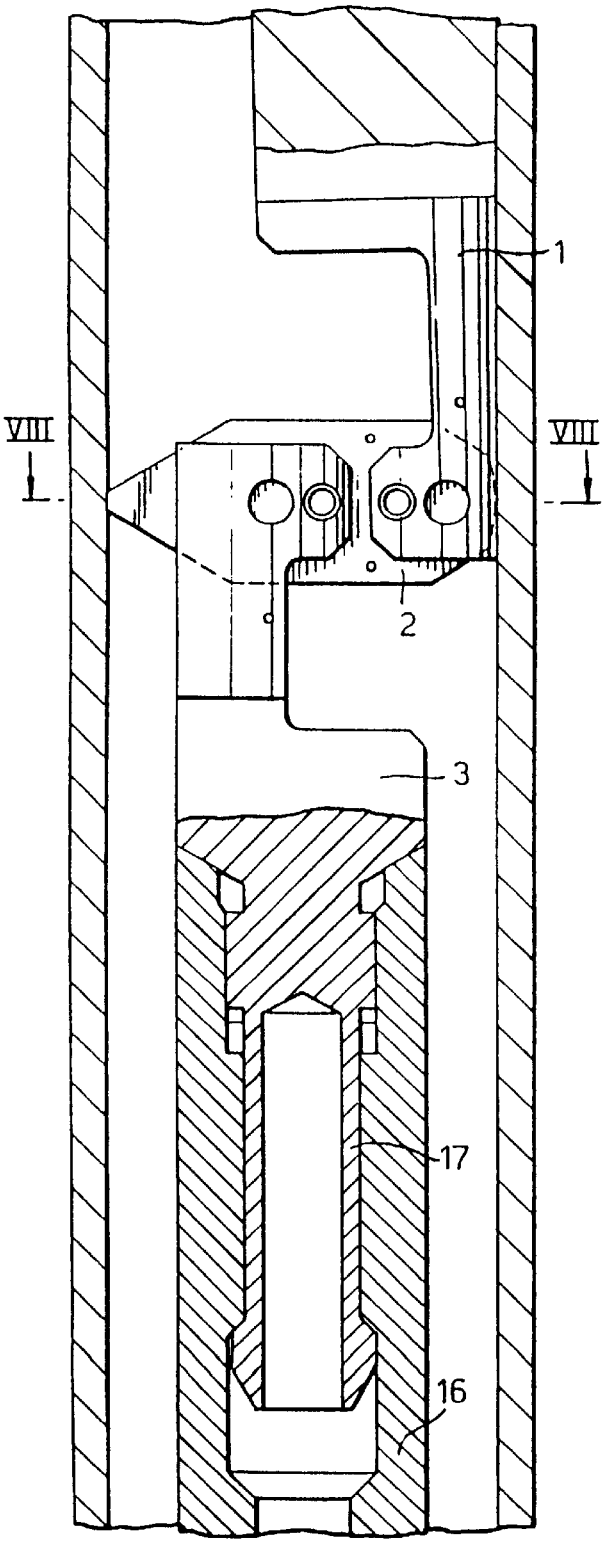
FIG. 7 illustrates operation of the connecting link located at the lower end of the guide member.
Figure 8:
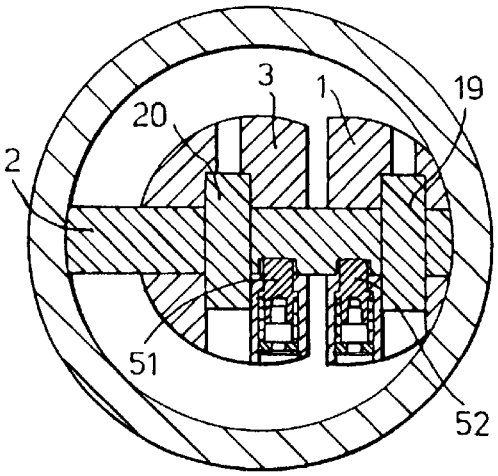
FIG. 8 is a cross-section on the line VIII–VIII of FIG. 7.
Figure 10:
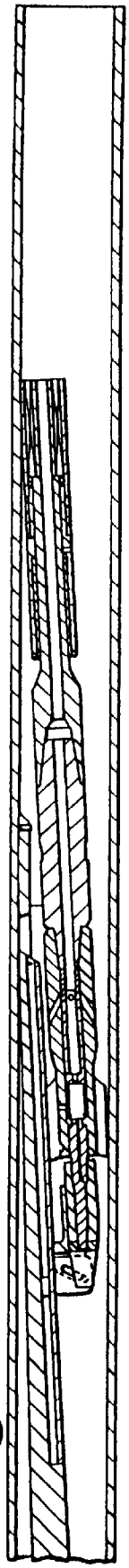
Figure 11:
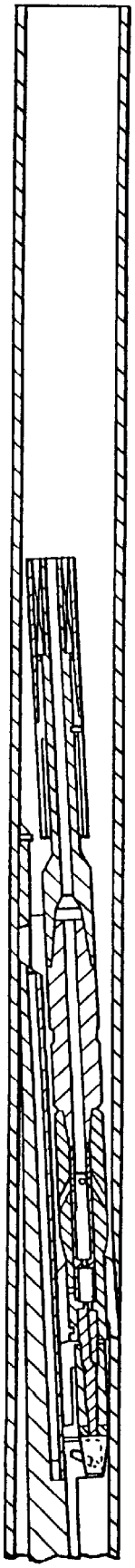

Preferably, a pair of spring loaded pins 51, 52 are provided to engage appropriate bores provided in the link 2 when the components have moved to the operating configuration illustrated in FIG. 7, thereby locking the hinge link in a configuration substantially perpendicular to the well axis. It will be noted that in the configuration shown in FIG. 7 any lateral force applied to the guide member 1 will be transmitted by the link 2 directly to the opposite casing wall thereof obviating any need on the part of the locating member 3 to withstand substantial lateral loading, enhancing reliability of the anchor/packer. After the guide member 1 has been moved to the position illustrated in FIG. 7, increased tension on the string will cause the pin 48 (which initially prevents relative rotation of the rotor and stator of the motor) to shear. Further increase in tension will then cause the pin 45 to shear. The milling assembly cannot part from the whipstock due to the travelling block 32 being retained within the track by a retaining pin 34. Compression is then applied to move the mill assembly down the whipstock guide track into the configuration illustrated in FIG. 9. Shear pin 48 would normally need a pull of, for example, 4000 lbs whilst the shear pin 45 would require a higher pull; for example 6000 lbs. Once the pin 45 has been sheared, the tubing string may be pressurized to energize the motor (having closed the bypass valve and ruptured the blow-out sub) and cause rotation of the output shaft 46 to rotate the mill blades of the milling means 6. In this connection, it will be appreciated that the generally crescent-shaped cross-section of the guide member 1 ensures that the blades 43 can rotate without causing damage to the guide member itself. With the milling means rotating it is lowered so that continued movement of the support member along the track 23 brings the milling means into engagement with the casing wall and milling starts. This configuration is shown in FIG. 10. Milling then continues until the milling means breaks through the casing wall and mills a clean shoulder at the lower edge of the resultant window. At this point, the various components are in the configuration illustrated in FIG. 11.

Figure 9:
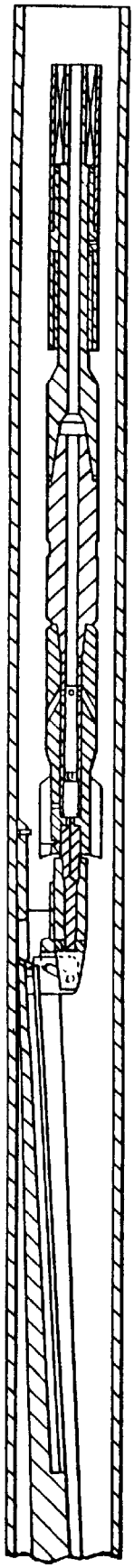
FIGS. 9–11 illustrate schematically operation of the embodiment of the present invention illustrated in FIGS. 1–8 to mill a window in a well casing.

When this configuration has been reached, the motor may be stopped and the string withdrawn to bring the components back to the position illustrated in FIG. 9. Further upward movement will cause the travelling block 32 to butt against the retaining pin 34. Tension on the string is then increased, e.g. to 12000 lbs to shear the retaining pin 34 and allow further upward motion of the milling assembly resulting in disengagement of the travelling block from the whipstock guideway. The string may now be withdrawn completely from the well leaving only the anchor/packer 16, the locating member 3 and the guide member 1 in position. A new string is then made up comprising a conventional window milling tool and a watermelon mill and this is run into the well. The string will run along the guide surface provided by the guide member 1 and complete milling of the window and finishing thereof by the watermelon tool. If desired, the string may be used to bore a passage someway beyond the window which has been formed.

Figure 12:
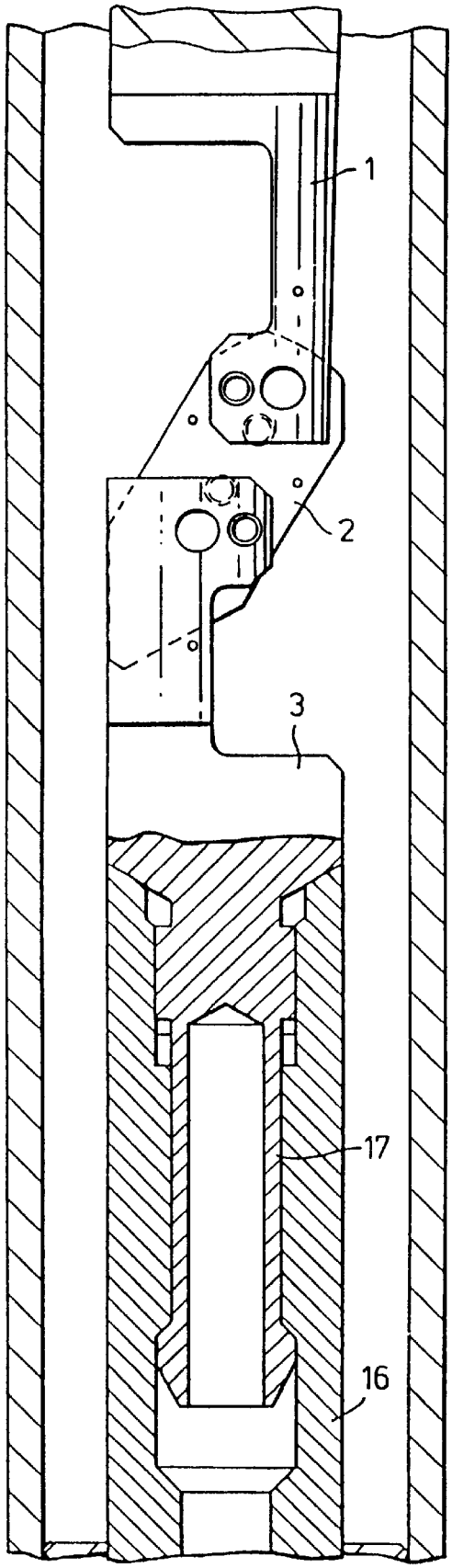
FIG. 12 illustrates the configuration of the connecting link during recovery of the tool.

The whipstock/latch/anchor assembly left in the hole can be retrieved by running an overshot into the hole and latching over the upper end 26 of the whipstock tail. When sufficient tension has been applied (typically 18000 lbs) the spring loaded pins 51,52 will be sheared in the latch mechanism allowing the hinge joint to be unlocked and accordingly allowing the hinge assembly to move to the configuration shown in FIG. 12. A further increase in tension to, for example, 25000 lbs will then cause the anchor to release allowing the complete assembly to be pulled back out of the hole through the internal restrictions of the tubing.

Whilst the invention has been described with particular reference to a starter milling tool which, after breaking through the casing, will in general be replaced by a window mill to form the required finished opening, it should be appreciated that the invention may be embodied to incorporate a window mill, so that the tool will not only break through the casing but will continue to operate to form the required finished window opening.

We claim:

1. Apparatus for milling a well casing comprising an elongate guide member having a leading end and a trailing end, the guide member having defined thereon a guide track which, in a use position of the guide member, converges with the well casing to be milled from the trailing end of the guide member towards one leading end thereof; a travelling block which is selectively moveable along the guide track in the direction from the trailing end towards the leading end of the guide member to converge with the well casing to be milled; a support member linked to the travelling block; a milling tool having a leading end rotatably supported by the support member and milling means located rearwardly of said leading end; a releasable coupling initially maintaining the support member and leading end of the milling tool adjacent the trailing end of the guide member and releasable to permit movement of the travelling block along the guide track towards the leading end of the guide member to bring the milling means into milling engagement with the casing to be milled; wherein the support member is linked to the travelling block by means of a pin which is provided on one of the support member or travelling block and is slidably located in a laterally extending pin slot provided on the other of the support member or travelling block, the pin and pin slot arrangement thereby permitting lateral movement of the milling tool away from the guide member.

2. Apparatus according to claim 1, wherein the guide member is in the form of a whipstock on which the guide track is provided as a milled groove.

3. Apparatus according to claim 1, wherein means are provided for retaining the traveling block in the correct position relative to the guide track as the traveling block advances along the guide track, said retainer means being releasable to permit subsequent withdrawal of the milling tool and support member from the well.

4. Apparatus according claim 1 including means for orientating the guide member relative to predetermined ground coordinates.

5. Apparatus according to claim 4, wherein said orientating means comprise a locating member which will mate with a previously set anchor in only one relative rotational position, the locating member being coupled to the leading end of the guide member by means which prevent relative rotation between the guide member and the locating member about the longitudinal axis of the tool.

6. Apparatus according to claim 1 wherein the leading end of the milling apparatus is supported in the support member via a sealed bearing system having a pressure compensated lubrication arrangement.

7. Apparatus according to claim 6, wherein the pressure compensated lubrication system comprises a lubricant reservoir defined in the leading end of the milling tool and connected to the sealed bearing system, one end of the lubricant reservoir being formed by a piston which is exposed on the other side thereof to well fluid pressure.

8. Apparatus according to claim 1, wherein the pin slot extends in a direction having components both parallel and perpendicular to the longitudinal axis of the milling apparatus.

9. Apparatus according to claims 1 or 8 wherein means are provided for orientating the guide member within the casing such that the trailing end of the guide member rests against the casing adjacent one side thereof and the leading end of the guide member is held adjacent the casing on the diametrically opposite side thereof to the point of engagement of the trailing end with the casing.

10. Apparatus according to claim 9, wherein the leading end of the guide member is connected to the next adjacent component of the system by a hinged link which is operative, during installation of the apparatus and prior to milling, to move the leading end of the guide member to a position adjacent one wall of the casing and to maintain the leading end of the guide member in that position during subsequent use.

11. Apparatus according to claim 10, wherein the hinged link itself engages the opposite wall of the casing to act as a strut to maintain the leading end of the guide member in the desired position.

* * * * *